US007257517B2

(12) United States Patent
Shitan

(10) Patent No.: US 7,257,517 B2
(45) Date of Patent: Aug. 14, 2007

(54) DETECTION APPARATUS, DETECTION SYSTEM, PORTABLE DEVICE, AND MACHINE READABLE MEDIUM

(75) Inventor: Yasuhiro Shitan, Kanagawa (JP)

(73) Assignee: Konami Sports Life Corporation, Tokyo (JP)

( * ) Notice: Subject to any disclaimer, the term of this patent is extended or adjusted under 35 U.S.C. 154(b) by 0 days.

(21) Appl. No.: 11/038,342

(22) Filed: Jan. 18, 2005

(65) Prior Publication Data

US 2005/0197541 A1 Sep. 8, 2005

Related U.S. Application Data

(63) Continuation of application No. PCT/JP03/06976, filed on Jun. 3, 2003.

(30) Foreign Application Priority Data

Jul. 18, 2002 (JP) ..... 2002-210308

(51) Int. Cl.
*G06F 17/40* (2006.01)

(52) U.S. Cl. ..... 702/187; 702/182

(58) Field of Classification Search ..... 702/187, 702/188, 182; 600/300; 340/573.1; 482/1–9, 482/55, 56; 705/2
See application file for complete search history.

(56) References Cited

U.S. PATENT DOCUMENTS 6,450,922 B1 * 9/2002 Henderson et al. ..... 482/8
6,571,200 B1 * 5/2003 Mault ..... 702/182
6,580,943 B2 * 6/2003 Nissila ..... 600/509
6,790,178 B1 * 9/2004 Mault et al. ..... 600/300
6,889,165 B2 * 5/2005 Lind et al. ..... 702/183
6,985,779 B2 * 1/2006 Hsiung et al. ..... 700/19
7,031,778 B2 * 4/2006 Hsiung et al. ..... 700/29
2003/0208113 A1 * 11/2003 Mault et al. ..... 600/316
2005/0113650 A1 * 5/2005 Pacione et al. ..... 600/300

FOREIGN PATENT DOCUMENTS

| | | |
|---|---|---|
| JP | 7-289540 | 11/1995 |
| JP | 9-53957 | 2/1997 |
| JP | 2000-288148 | 10/2000 |
| JP | 2001-112904 | 4/2001 |
| JP | 2001-246033 | 9/2001 |

OTHER PUBLICATIONS

International Search Report dated Sep. 16, 2003.

* cited by examiner

*Primary Examiner*—Marc S. Hoff
*Assistant Examiner*—Anthony Gutierrez
(74) *Attorney, Agent, or Firm*—John J. Penny, Jr.; Edwards Angell Palmer & Dodge LLP

(57) ABSTRACT

A detection apparatus that detects an exercise history of a user in a swimming pool includes: a plurality of receiving units operable to receive user identifying information for identifying the user from a portable device retained by the user; a recording unit operable to recording receiving unit identifying information for identifying one of the receiving units in association with the user identifying information when the one receiving unit receives the user identifying information; and a activity amount computing unit operable to compute a physical activity amount of the user based on a history of the receiving unit identifying information stored in association with the user identifying information.

23 Claims, 11 Drawing Sheets

210

| # | USER IDENTIFYING INFORMATION | RECEIVING UNIT IDENTIFYING INFORMATION | TIME INFORMATION |
|---|---|---|---|
| 1 | A | 001 | 13:00:00 |
| 2 | A | 002 | 13:00:30 |
| 3 | A | 001 | 13:01:00 |
| ⁓ | ⁓ | ⁓ | ⁓ |
| 100 | B | 009 | 13:09:30 |
| 101 | B | 015 | 13:10:40 |
| ⁓ | ⁓ | ⁓ | ⁓ |

FIG. 4

225

| # | RECEIVING UNIT IDENTIFYING INFORMATION | X COORDINATE | Y COORDINATE |
|---|---|---|---|
| 1 | 001 | 0m | 15m |
| 2 | 002 | 50m | 15m |
| ⋮ | ⋮ | ⋮ | ⋮ |

FIG. 5

250

| # | USER IDENTIFYING INFORMATION | WEIGHT | HEIGHT | TEMPERATURE |
|---|---|---|---|---|
| 1 | A | 65kg | 170cm | 36.3℃ |
| 2 | B | 48kg | 165cm | 36.5℃ |
| ⋮ | ⋮ | ⋮ | ⋮ | ⋮ |

FIG. 6

DETECTION APPARATUS, DETECTION SYSTEM, PORTABLE DEVICE, AND MACHINE READABLE MEDIUM

This patent application is a continuation application of PCT/JP2003/006976 filed on Jun. 3, 2003, which claims priority from a Japanese Patent Application No. 2002-210308 filed on Jul. 18, 2002, the contents of which are incorporated herein by reference.

BACKGROUND OF THE INVENTION

1. Field of the Invention

The present invention relates to a detection apparatus, a detection system, a portable device, and a machine readable medium. More particularly, the present invention relates to a detection apparatus, a detection system, a portable device, and a machine readable medium, which detect an exercise history of a user in a swimming pool.

2. Description of Related Art

Conventionally, those who use facilities such as a training gym or a fitness club perform a workout and the resistance training by exercising themselves to burn calories. An effect provided by exercise such as a workout or the resistance training greatly depends upon a physical activity amount of a user. For this purpose, a training gym or a fitness club is provided with equipments capable of easily measuring a physical activity amount of an exercise bike or the like.

Exercise in a swimming pool is proposed as effective activity that can be used for the workout and the resistance training. Japanese Patent Laid-Open No. 2000-288148 discloses a method that receives an identification code of an ID tag put on a body of a user from an antenna provided at a predetermined position in a path of the user and computes an exercising time of the user based on the received time.

In the Japanese Patent Laid-Open No. 2000-288148, it is premised that a user swims in a specific path (for example, a lane of a swimming pool). On the other hand, in a training gym and a fitness club, a user may freely swim in a swimming pool, and a fitness effect may be generated by exercise except swimming. Therefore, it is desirable that equipment capable of adequately measuring a physical activity amount of a user and computing its consumption calories is realized.

Therefore, it is an object of the present invention to provide a detection apparatus, a detection system, a portable device, and a program which can solve the foregoing problems. The above and other objects can be achieved by combinations described in the independent claims. The dependent claims define further advantageous and exemplary combinations of the present invention.

SUMMARY OF THE INVENTION

To achieve the object, according to the first aspect of the present invention, there is provided a detection apparatus that detects an exercise history of a user in a swimming pool. The detection apparatus includes: a plurality of receiving units operable to receive user identifying information for identifying the user from a portable device retained by the user; a recording unit operable to recording receiving unit identifying information for identifying one of the receiving units in association with the user identifying information when the one receiving unit receives the user identifying information; and a activity amount computing unit operable to compute a physical activity amount of the user based on a history of the receiving unit identifying information stored in association with the user identifying information.

The activity amount computing unit may compute the physical activity amount based on a distance between the two receiving units, which receive user identifying information in tandem, the user identifying information being stored on the history of the receiving unit identifying information corresponding to the user identifying information.

The recording unit may further record time information indicating the time when receiving the corresponding user identifying information in association with the receiving unit identifying information, and the activity amount computing unit may compute the physical activity amount based on the receiving unit identifying information and the time information.

The detection apparatus may further include a user information holding unit operable to hold user information including the weight of the user, and a calorie computing unit operable to compute consumption calories of the user based on the held weight and the physical activity amount.

The recording unit may further record time information indicating the time when receiving the corresponding user identifying information in association with the receiving unit identifying information, the activity amount computing unit may compute a moving distance and a moving speed included in the physical activity amount of the user based on the receiving unit identifying information and the time information, and the calorie computing unit may compute the consumption calories based on the moving distance, the moving speed, and the user information.

The user information may further include the user's height, and the calorie computing unit may further compute the consumption calories based on the user's height.

The recording unit may further record time information indicating the time when receiving the corresponding user identifying information from the portable device as the receiving unit identifying information, the detection apparatus may further include a staying time computing unit operable to compute a staying time for which the user was staying in the swimming pool, and a calorie computing unit operable to compute consumption calories of the user based on the physical activity amount and the staying time.

The plurality of receiving unit may be provided in both ends of a predetermined lane in the swimming pool.

The plurality of receiving unit may be provided in a bottom face of the swimming pool.

The plurality of receiving unit may be provided in a bottom face of the swimming pool in a lattice-shape.

The portable device may send the user identifying information at predetermined times.

The detection apparatus may further include a plurality of activity amount sending units operable to send the physical activity amount to the portable device retained by the user.

The activity amount sending units may respectively be provided in the vicinity of the receiving units in correspondence with the receiving units for sending the physical activity amount from the activity amount sending unit corresponding to the one receiving unit to the portable device of the user when the one receiving unit receives the user identifying information.

The detection apparatus may further include a pool status acquiring unit operable to acquire a pool status that is an internal status of the swimming pool, and a calorie computing unit operable to compute consumption calories of the user based on the physical activity amount and the pool status.

The pool status acquiring unit may include a water temperature acquiring unit that acquires a water temperature of the swimming pool as a pool status, and the calorie computing unit may compute the consumption calories of the user based on the physical activity amount and the water temperature.

The user information may further include a user's temperature measured beforehand, the calorie computing unit may compute the consumption calories of the user based on the physical activity amount and a difference between the user's temperature and the water temperature.

The pool status acquiring unit may include a flow information acquiring unit that acquires flow information including an intensity of a flow of the swimming pool as a pool status, and the calorie computing unit may compute the consumption calories of the user based on the physical activity amount and the flow information.

The swimming pool may include a flow generating apparatus that generates a flow, and the flow information acquiring unit may acquire flow information including an intensity of a flow generated from the flow generating apparatus as a pool status.

The pool status acquiring unit may include a density computing unit that computes density information indicating density of the plurality of users in the swimming pool as a pool status based on the history of the receiving unit identifying information that the plurality of receiving units receives from the plurality of portable devices carried by the plurality of users, and the calorie computing unit may compute the consumption calories of the user based on the physical activity amount and the density information.

The pool status acquiring unit may include a flow computing unit that computes flow information indicating a flow in the swimming pool generated by a movement of the plurality of users as a pool status based on the history of the receiving unit identifying information that the plurality of receiving units receives from the plurality of portable devices carried by the plurality of users, and the calorie computing unit may compute the consumption calories of the user based on the physical activity amount and the flow information.

In addition, according to the second aspect of the present invention, there is provided a detection system that detects an exercise history of a user in a swimming pool. The detection system includes: a portable device operable to send user identifying information for identifying the user, the portable device is retained by the user; and a detection apparatus operable to receive the user identifying information from the portable device and compute a physical activity amount of the user, in which the detection apparatus includes: a plurality of receiving units operable to receive user identifying information for identifying the user from the portable device retained by the user; a recording unit operable to recording receiving unit identifying information for identifying one of the receiving units in association with the user identifying information when the one receiving unit receives the user identifying information; and a activity amount computing unit operable to compute a physical activity amount of the user based on a history of the receiving unit identifying information stored in association with the user identifying information.

In addition, according to the third aspect of the present invention, there is provided a machine readable medium storing a program for a detection apparatus that detects an exercise history of a user in a swimming pool. The program causes the detection apparatus to operate by way of: a plurality of receiving units operable to receive user identifying information for identifying the user from a portable device retained by the user; a recording unit operable to recording receiving unit identifying information for identifying one of the receiving units in association with the user identifying information when the one receiving unit receives the user identifying information; and a activity amount computing unit operable to compute a physical activity amount of the user based on a history of the receiving unit identifying information stored in association with the user identifying information.

In addition, according to the fourth aspect of the present invention, there is provided a detection apparatus that detects an exercise history of a user in a swimming pool. The detection apparatus includes: an acquiring unit operable to acquire a plurality of sending unit identifying information, which is received and stored by a portable device from a plurality of sending units that sends sending unit identifying information different from each other to the portable device retained by the user, from the portable device as an exercise history of the user; and a activity amount computing unit operable to compute a physical activity amount of the user based on the plurality of sending unit identifying information acquired by the acquiring unit.

The activity amount computing unit may compute the physical activity amount with respect to each of the plurality of sending unit identifying information acquired by the acquiring unit based on a distance between the two sending units, which receive sending unit identifying information in tandem.

In addition, according to the fifth aspect of the present invention, there is provided a portable device that detects an exercise history of a user in a swimming pool. The portable device includes: a receiving unit operable to receive sending unit identifying information from a plurality of sending units that is provided in the swimming pool and sends sending unit identifying information different from each other; a storing unit operable to store the received sending unit identifying information; and a transmitting unit operable to transmit the sending unit identifying information stored on the storing unit as an exercise history of the user.

In addition, according to the sixth aspect of the present invention, there is provided a detection system that detects an exercise history of a user in a swimming pool. The detection system includes: a plurality of sending units operable to send sending unit identifying information different from each other; a portable device operable to receive and store the plurality of sending unit identifying information, the portable device is retained by the user; and a detection apparatus operable to compute a physical activity amount of the user based on the plurality of sending unit identifying information stored on the portable device, in which the portable device includes: a receiving unit that receives the sending unit identifying information from either of the sending units; a storing unit that stores the received sending unit identifying information; and a transmitting unit that transmits the plurality of sending unit identifying information stored on the storing unit to the detection apparatus, and the detection apparatus includes: an acquiring unit that acquires the plurality of sending unit identifying information stored on the storing unit from the transmitting unit; and a activity amount computing unit that computes a physical activity amount of the user based on the plurality of sending unit identifying information acquired by the acquiring unit.

In addition, according to the seventh aspect of the present invention, there is provided a machine readable medium storing a program for a detection apparatus that detects an exercise history of a user in a swimming pool. The program causes the detection apparatus to operate by way of: an acquiring unit operable to acquire a plurality of sending unit identifying information, which is received and stored by a portable device from a plurality of sending units that sends sending unit identifying information different from each other to the portable device retained by the user, from the portable device as an exercise history of the user; and a activity amount computing unit operable to compute a physical activity amount of the user based on the plurality of sending unit identifying information acquired by the acquiring unit.

The summary of the invention does not necessarily describe all necessary features of the present invention. The present invention may also be a sub-combination of the features described above.

BRIEF DESCRIPTION OF THE DRAWINGS

FIG. 4 is a drawing exemplary showing a position history database according to an embodiment of the present invention in a tabular form.

FIG. 5 is a drawing exemplary showing a receiving unit database according to an embodiment of the present invention in a tabular form.

FIG. 6 is a drawing exemplary showing a user information holding unit according to an embodiment of the present invention in a tabular form.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
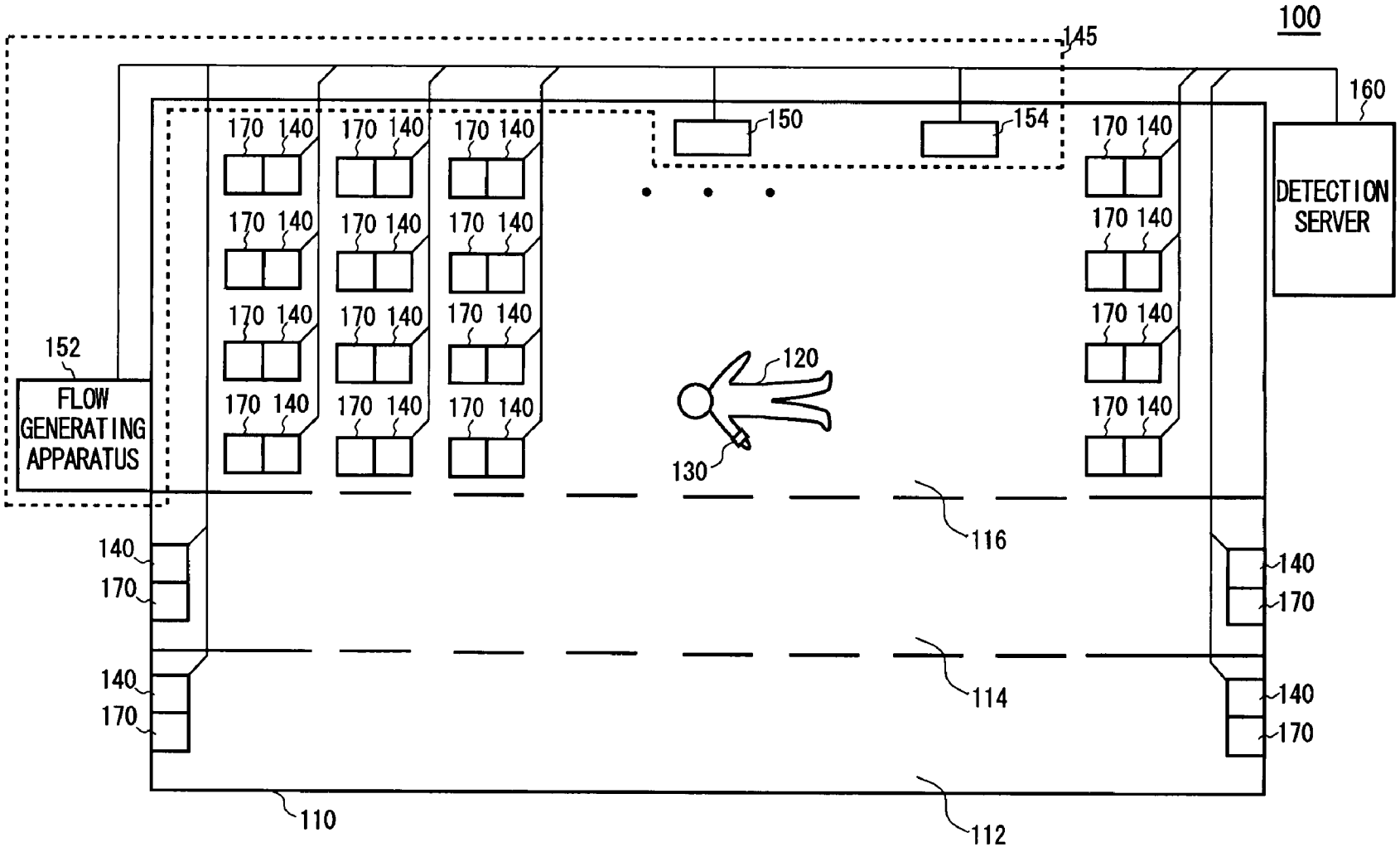
FIG. 1 shows a configuration of a detection system according to an embodiment of the present invention.

FIG. 1 shows a configuration of a detection system 100 according to an embodiment of the present invention. The detection system 100 according to the present embodiment includes a swimming pool 110, a portable device 130, a plurality of receiving units 140, a pool status measuring unit 145, a detection server 160, and a plurality of activity amount sending unit 170. The receiving unit 140, the detection server 160, and the activity amount sending unit 170 according to the present embodiment are an example of a detection apparatus that detects an exercise history of the user in the swimming pool.

The swimming pool 110 includes a lane A 112 and a lane B 114 provided for users to swim, and a free region 116 provided for the user 120 to freely do in-water exercise. Here, the swimming pool 110 may be used by a plurality of users. In the present embodiment, the case of detecting an exercise history of the user 120 representing the plurality of users will mainly be explained.

The portable device 130 is retained by the user 120, and sends user identifying information for identifying the user 120 by radio. The portable device 130 may be a portable information device, a non-contact IC card or the like having a wristband being fixed to an arm, a head, or a foot of the user 120.

When the portable device 130 retained by the user 120 approaches within a predetermined distance (for example, 50 cm, etc.), each of the receiving units 140 receives user identifying information for identifying the user 120 and sends it to the detection server 160. Some of the receiving units 140 are provided on sidewall faces of the swimming pool 110 in both ends of each of the lane A 112 and the lane B 114. In addition, some of the other receiving units 140 are provided in a bottom face of the swimming pool 110 in the free region 116 in a reticular pattern.

The pool status measuring unit 145 measures a pool status, which is an internal status of the swimming pool 110, and sends it to the detection server 160. The pool status measuring unit 145 includes a water temperature measuring unit 150, a flow generating apparatus 152, and a flow measuring unit 154.

The water temperature measuring unit 150 measures a water temperature of the swimming pool 110 as a pool status, and sends it to the detection server 160. The flow generating apparatus 152 generates, for example, a flow in a horizontal direction and/or a flow in a vertical direction (a wave, etc.) in the swimming pool 110. In addition, the flow generating apparatus 152 sends flow information including an intensity of the generated flow to the detection server 160 as a pool status. The flow measuring unit 154 acquires flow information including an intensity of the flow generated by the flow generating apparatus 152 and/or an intensity of a flow in the swimming pool generated by movements of the plurality of users in the swimming pool as a pool status. The flow measuring unit 154 may further acquire a direction of the flow in the swimming pool as flow information. In addition, the flow measuring unit 154 may acquire amplitude of waves in the swimming pool as flow information by means of, e.g., a water level indicator for measuring water level.

As described above, the pool status measuring unit 145 may further measure water level of the swimming pool 110, density of the users or the like as a pool status.

The detection server 160 detects the exercise history of the user 120 based on the user identifying information received from the portable device 130 via the receiving unit 140. The detection server 160 computes a physical activity amount of the user 120 based on the exercise history of the user 120, and computes calorie consumption of the user 120 using the physical activity amount. In addition, the detection server 160 sends the computed activity amount of the user 120 to the portable device 130 to inform the user 120 of it.

The activity amount sending unit 170 receives information such as the physical activity amount of the user 120 from the detection server 160. The activity amount sending unit 170 sends information such as the physical activity amount of the user 120 to the portable device 130 retained by the user 120 by radio. Here, each of the activity amount sending units 170 is respectively provided in the vicinity of the receiving units 140 in correspondence with the receiving units 140. When a certain receiving unit 140 has received user identifying information, the detection server 160 sends information such as a physical activity amount from the activity amount sending unit 170 corresponding to that receiving unit 140 to the portable device 130.

Figure 2:
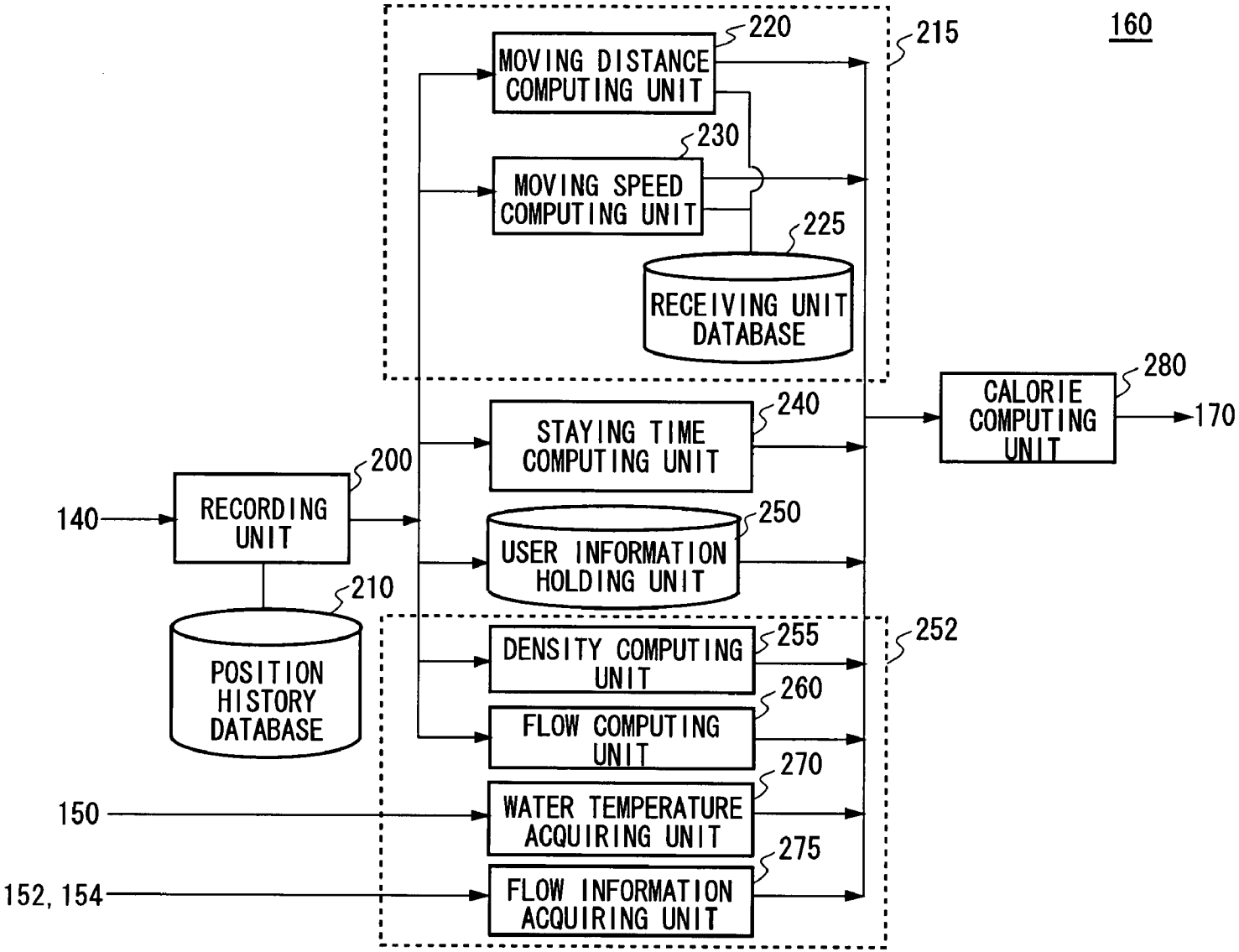
FIG. 2 shows a configuration of a detection server according to an embodiment of the present invention.

FIG. 2 shows a configuration of the detection server 160 according to an embodiment of the present invention. The detection server 160 according to the present embodiment includes a recording unit 200, a position history database 210, an activity amount computing unit 215, a staying time computing unit 240, a user information holding unit 250, a pool status acquiring unit 252, and a calorie computing unit 280.

When either of the receiving units 140 has received the user identifying information from the portable device 130, the recording unit 200 records the user identifying information and the time information indicating the time when receiving the user identifying information in the position history database 210 in association with the receiving unit identifying information for identifying that receiving unit 140. Here, the recording unit 200 may record information consisting of a date and time, or may record information consisting of only time, as time information. The recording unit 200 may also record time, or may record a time that has elapsed from a specific time instant, as time information. The position history database 210 stores a group of the user identifying information, the receiving unit identifying information, and the time information recorded by the recording unit 200 as a position history of the user 120.

The activity amount computing unit 215 computes the physical activity amount of the user 120 based on the history of the receiving unit identifying information stored on the position history database 210 in association with the user identifying information. The activity amount computing unit 215 according to the present embodiment computes a moving distance and a moving speed of the user 120 as a physical activity amount of the user 120. The activity amount computing unit 215 includes a moving distance computing unit 220, a receiving unit database 225, and a moving speed computing unit 230.

The moving distance computing unit 220 computes the moving distance of the user 120 based on the position history of the user 120 stored on the position history database 210. Specifically, the moving distance computing unit 220 acquires the history of the receiving unit identifying information corresponding to the user identifying information on the user 120 from the position history database 210 via the recording unit 200. In addition, the moving distance computing unit 220 computes the moving distance to be included in the physical activity amount by computing a distance between the two receiving units 140, which receive user identifying information in tandem, in the history of the acquired receiving unit identifying information. Here, the moving distance computing unit 220 according to the present embodiment computes the distance between the two receiving units 140 based on position information on each receiving unit 140 stored on the receiving unit database 225.

The moving speed computing unit 230 computes the moving speed of the user 120 based on the position history of the user 120 stored on the position history database 210. Specifically, the moving speed computing unit 230 acquires the history of the receiving unit identifying information and the time information corresponding to the user identifying information on the user 120 from the position history database 210 via the recording unit 200. In addition, the moving speed computing unit 230 computes the moving speed to be included in the physical activity amount by computing a distance and a time difference between the two receiving units 140, which receive user identifying information in tandem, from the history of the acquired receiving unit identifying information. Here, the moving speed computing unit 230 according to the present embodiment computes the distance between the two receiving units 140 like the moving distance computing unit 220.

In the above-mentioned process, the moving speed computing unit 230 may detect a recess of the user 120, for example, based on the fact that the receiving unit identifying information has not been received for a certain period. In this case, the moving speed computing unit 230 can compute the moving speed using a time except the time for which the user 120 is resting.

The staying time computing unit 240 computes a staying time for which the user was staying in the swimming pool based on time information about the user 120 stored on the position history database 210. Specifically, the staying time computing unit 240 according to the present embodiment considers a difference between the earliest time information and the latest time information as the staying time for which the user 120 was staying in the swimming pool 110. Here, the earliest and the latest time information are acquired from the history of the time information corresponding to the user identifying information on the user 120 stored on the position history database 210.

Alternatively, the detection system 100 may further include an input device for inputting entering and leaving time when the user 120 enters into and leaves from the swimming pool 110. In this case, the staying time computing unit 240 may acquire the time when the user enters the swimming pool and the time when the user leaves from the swimming pool from this input device.

Alternatively, the detection system 100 may include a receiving unit for checking the entering and leaving to/from the pool that receives the user identifying information from the portable device 130 on a part or all of peripheral edge of the swimming pool 110. In this case, the staying time computing unit 240 may alternately acquire the time when the user enters the swimming pool or the time when the user leaves from the swimming pool, for example, every time the receiving unit for checking the use of the pool receives the user identifying information on the user 120.

The user information holding unit 250 holds user information including the weight and height of the user 120 in association with the user 120.

The pool status acquiring unit 252 acquires a pool status that is an internal status of the swimming pool 110. The pool status acquiring unit 252 according to the present embodiment includes a density computing unit 255, a flow computing unit 260, a water temperature acquiring unit 270, and a flow information acquiring unit 275.

The density computing unit 255 computes density information indicating density of the plurality of users in the swimming pool 110 as a pool status based on the receiving unit identifying information that is received from the plurality of portable devices 130 via the plurality of receiving units 140 and stored on the position history database 210.

Here, the density computing unit 255 may compute user density of the entire area of the pool 110, for example, by computing the number of the users who are in the swimming pool 110 based on the receiving unit identifying information and dividing the number of the users by an area or a volume of the swimming pool. Alternatively, the density computing unit 255 may compute user density for each partition that is defined by dividing the swimming pool 110 into a predetermined area or volume.

The flow computing unit 260 computes a flow generated by movements of the plurality of users in the swimming pool 110 as a pool status. Specifically, the flow computing unit 260 computes a movement direction and a movement amount of the plurality of users in the swimming pool 110 based on the receiving unit identifying information that is received from the plurality of portable devices 130 via the plurality of receiving units 140 and stored on the position history database 210. Further, the flow computing unit 260 computes local water flows at each user's position based on the movement direction and the movement amount of each of the users, and computes a water flow of the whole swimming pool 110 from these water flows using a technique of fluid analysis.

The water temperature acquiring unit 270 acquires the water temperature of the swimming pool 110 measured by the water temperature measuring unit 150 from the water temperature measuring unit 150 as a pool status.

The flow information acquiring unit 275 acquires flow information including an intensity of the flow of the swimming pool 110 from the flow generating apparatus 152 and the flow measuring unit 154 as a pool status.

The calorie computing unit 280 computes the consumption calories of the user 120 based on the activity amount including the moving distance and the moving speed computed by the activity amount computing unit 215, the staying time computed by the staying time computing unit 240, the user information including the user's weight and height held in the user information holding unit 250, and the pool status including the water temperature, the flow information, and the density information on the swimming pool 110 computed or acquired by the pool status acquiring unit 252. Further, the calorie computing unit 280 sends information such as the activity amount of the user 120 to the portable device 130 via the activity amount sending unit 170 by radio. Here, when the recording unit 200 receives the user identifying information from a certain receiving unit 140, the activity amount computing unit 215, the staying time computing unit 240, the user information holding unit 250, the water temperature acquiring unit 270, and the calorie computing unit 280 perform the processes for the received user identifying information while the user 120 is located in the vicinity of that receiving unit 140. Further, the calorie computing unit 280 sends information such as the activity amount and the consumption calories to the portable device 130 via the activity amount sending unit 170 corresponding to that receiving unit 140.

The calorie computing unit 280 according to the present embodiment computes the consumption calories by means of the following methods.

(1) Consumption Calories by Activity

The calorie computing unit 280 according to the present embodiment computes consumption calories by activity based on information such as the physical activity amount, the staying time, the density information, the flow information, and/or the weight. For example, the calorie computing unit 280 computes a type of activity (an underwater walk, a swimming, etc.) and an intensity of the activity of the user 120 from the moving speed. In addition, the calorie computing unit 280 considers the moving distance or the staying time as activity time. Further, the calorie computing unit 280 computes the consumption calories from the activity intensity, the activity time, and the weight, which is user information stored on the user information holding unit 250. Here, the calorie computing unit 280 may further acquire age and/or sex of the user 120 from the user information holding-unit 250, and adjust the consumption calories using these.

In addition, the calorie computing unit 280 may compute the calories of the user 120 based on the density information computed by the density computing unit 255. Specifically, the calorie computing unit 280 computes, for example, "the consumption calories by the density of the users=$\alpha\times$the density of the users" using the density of the users in the region where the user 120 is located in the swimming pool 110 in order to add it to the consumption calories of the user 120. In this way, when it is decided that the density of the users is high, the calorie computing unit 280 increases the consumption calories of the user 120. Therefore, it is possible to reflect the influence that the consumption calories of the user 120 increase because of the increase of local waves which occur in the swimming pool 110.

In addition, the calorie computing unit 280 may compute the direction and intensity of the flow in the position of the user 120 based on the flow information computed by the flow computing unit 260 and/or the flow information acquired by the flow information acquiring unit 275 and the intensity of activity of the user 120 from the movement direction and moving speed of the user 120, and may compute the consumption calories of the user 120 using these. In this way, when it is decided that flow resistance against the user 120 is high, the calorie computing unit 280 can increase the consumption calories of the user 120. Alternatively, when the flow information indicates that the waves in the swimming pool are higher than ordinary times, the calorie computing unit 280 may increase the consumption calories of the user 120.

(2) Consumption Calories by Staying in the Swimming Pool 110

The calorie computing unit 280 according to the present embodiment computes the consumption calories by staying in the swimming pool 110 based on information such as the staying time, the weight, the height, and/or the water temperature. For example, the calorie computing unit 280 computes an area of body surface of the user 120 from the weight and height of the user 120 held in the user information holding unit 250. Next, the calorie computing unit 280 computes a heat dissipation amount of the user 120 from the time for which the user 120 is staying in the swimming pool 110, the water temperature of the swimming pool 110, and the area of body surface of the user 120. Then, the calorie computing unit 280 computes the consumption calories of the user 120 based on the computed heat dissipation amount. Alternatively, the calorie computing unit 280 may compute the calories of the user 120 based on difference between the temperature of the user 120 and the water temperature. More specifically, the calorie computing unit 280 may compute the calories used by the user 120 staying in the swimming pool 110 by using "$\beta\times$(the temperature of the user−the water temperature)". Here, the coefficient $\beta$ may be predetermined according to the height, the weight, and the staying time, or may be an approximate value that is obtained by multiplying a standard value determined irrespective of the height and the weight by the staying time. In addition, when the water temperature of the swimming pool 110 is different from a predetermined reasonable water temperature of the swimming pool 110 more than tolerance level, the calorie computing unit 280 may increase the consumption calories of the user 120.

Hereinbefore, the calorie computing unit 280 may hold a table in which statistic values such as the relationship between, e.g., the activity intensity and the consumption calories are stored as variables, and may compute the consumption calories using the variables in the table.

Figure 3:
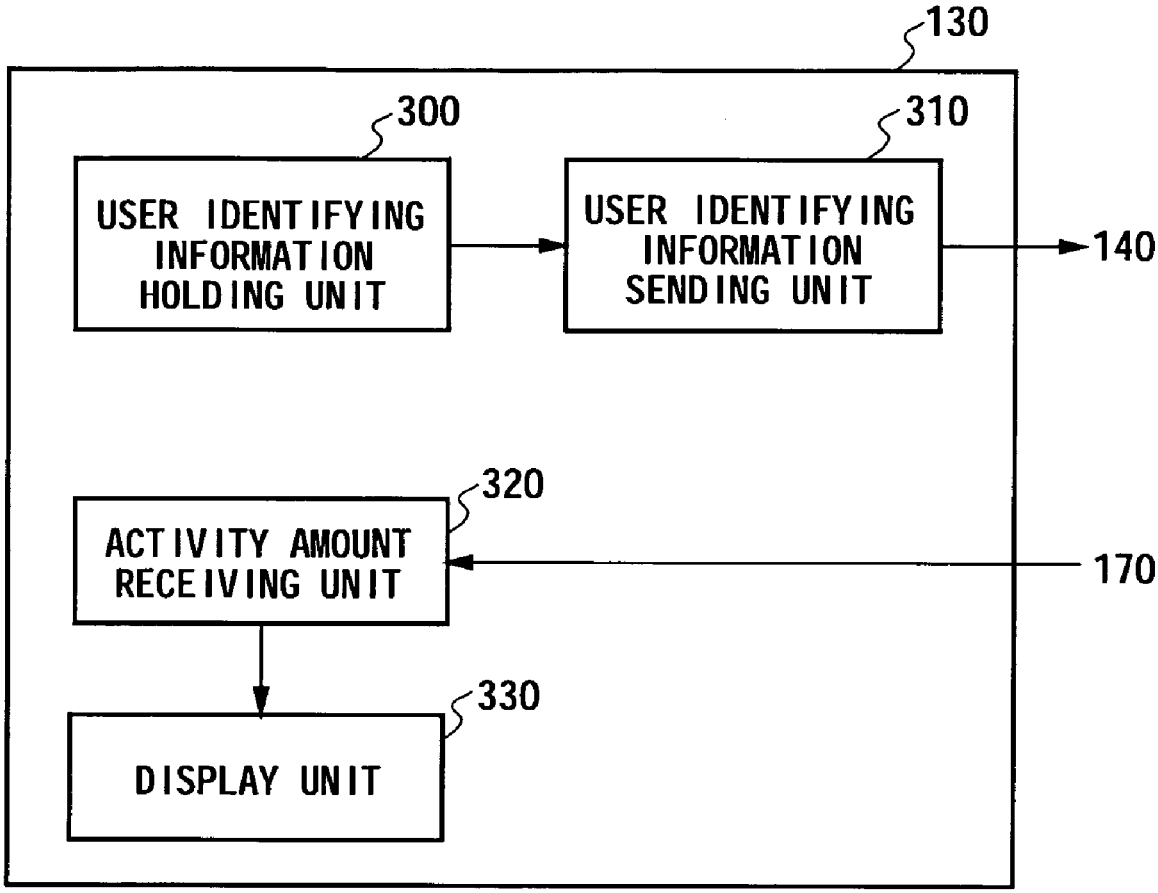
FIG. 3 shows a configuration of a portable device according to an embodiment of the present invention.

FIG. 3 shows a configuration of the portable device 130 according to an embodiment of the present invention. The portable device 130 according to the present. embodiment includes a user identifying information holding unit 300, a user identifying information sending unit 310, an activity amount receiving unit 320, and a display unit 330.

The user identifying information holding unit 300 holds user identifying information on the user 120. For example, the user identifying information sending unit 310 sends the user identifying information in the user identifying information holding unit 300 at a predetermined time. Alternatively, when, the user comes close to either of the receiving units 140, the user identifying information sending unit 310 may send the user identifying information in the user identifying information holding unit 300. In other words, for example, the receiving unit 140 may send radio wave for prompting transmission to the user identifying information sending unit 310, and the user identifying information sending unit 310 may receive it and send the user identifying information in the user identifying information holding unit 300.

The activity amount receiving unit 320 receives information such as the activity amount and consumption calories of the user 120 sent from the calorie computing unit 280 within the detection server 160 via the activity amount sending unit 170. The display unit 330 displays the activity amount information such as the activity amount and/or consumption calories of the user 120 received through the activity amount sending unit 170. The display unit 330 may further display information, e.g., the staying time computed by the staying time computing unit 240 and the water temperature of the swimming pool 110 acquired by the water temperature acquiring unit 270.

FIG. 4 is a drawing exemplary showing the position history database 210 according to an embodiment of the present invention in a tabular form. The position history database 210 stores receiving unit identifying information for identifying the receiving unit 140 that has received the user identifying information and time information indicating the time when the receiving unit 140 has received the user identifying information in association with the user identifying information received from the portable device.

For example, the first row to the third row in FIG. 4 show that the user identified by user identifying information A travels back and forth between the receiving units 140 respectively identified by receiving unit identifying information 001 and receiving unit identifying information 002 at intervals of 30 seconds. For example, when the two receiving units 140 respectively identified by the receiving unit identifying information 001 and the receiving unit identifying information 002 are provided in both ends of the lane A 112, it can be considered that the user identified by the user identifying information A swims back and forth between both ends of the lane A 112.

In addition, the 100th row and the 101st row of FIG. 4 show that the user identified by the user identifying information B moves from the vicinities of the receiving unit 140 identified by receiving unit identifying information 009 to the vicinities of the receiving unit 140 identified by receiving unit identifying information 015 for 1 minute 10 seconds. For example, when the receiving units 140 respectively identified by the receiving unit identifying information 009 and 015 are provided in the bottom face of the free region 116, the activity amount computing unit 215 can detect the movement of the user identified by user identifying information B in the free region 116 by referring to the history of the receiving unit identifying information recorded in the position history database 210.

Hereinbefore, the time information may be information indicating the time when the recording unit 200 has received the user identifying information from the receiving unit 140. In addition, the time information may include information indicating the time when the receiving unit 140 has not received the user identifying information in addition to the time when the receiving unit 140 has received the user identifying information.

FIG. 5 is a drawing exemplary showing the receiving unit database 225 according to an embodiment of the present invention in a tabular form. The receiving unit database 225 stores the X and Y coordinates that are an example of position information on that receiving unit 140 in the swimming pool 110 in correspondence with each of the receiving units 140. The moving distance computing unit 220 and the moving speed computing unit 230 compute a distance between the two receiving units 140, which receive user identifying information in tandem, from the history of the receiving unit identifying information stored on the position history database 210 in association with the users 120 using each of the X and Y coordinates of the two receiving units stored on the receiving unit database 225.

FIG. 6 is a drawing exemplary showing the user information holding unit 250 according to an embodiment of the present invention in a tabular form. The user information holding unit 250 holds user information including the weight and height of that user and the temperature of that user measured beforehand in correspondence with the user identifying information on each user. The user information holding unit 250 may further hold information such as age and sex of the user as the user information.

Figure 7:
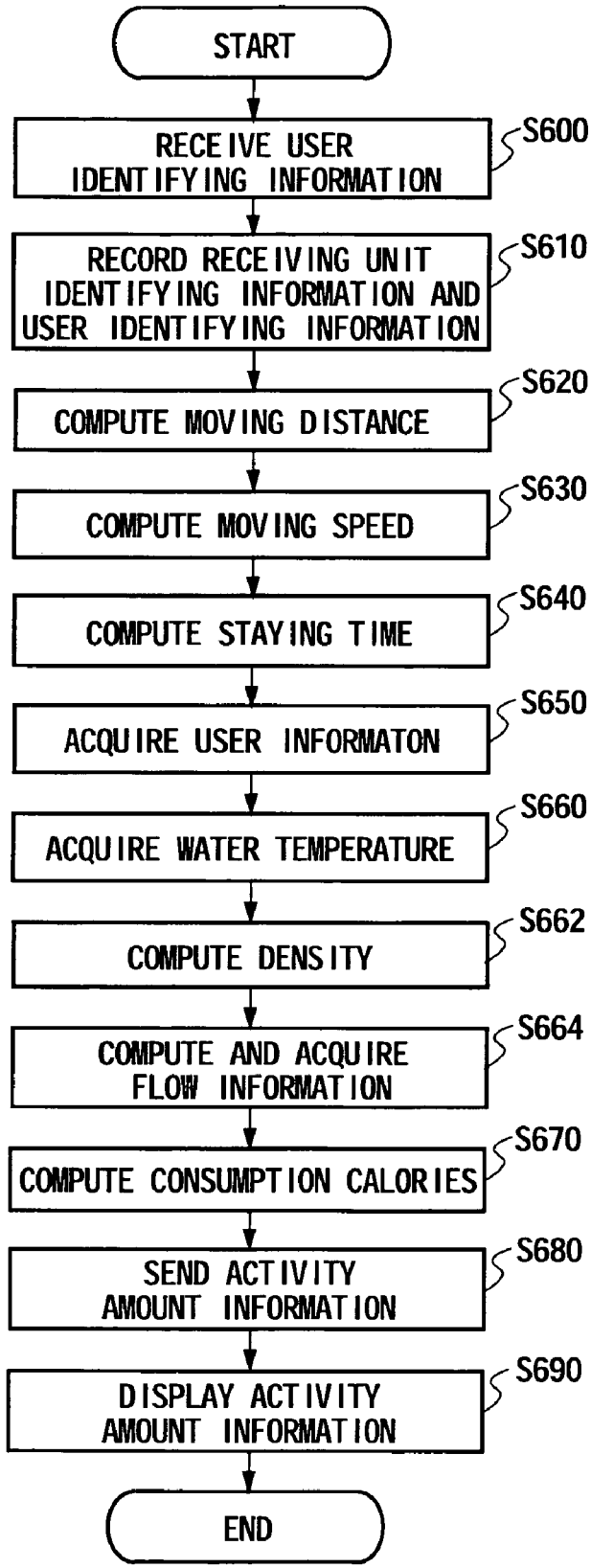
FIG. 7 shows a process flow of the detection system according to an embodiment of the present invention.

FIG. 7 shows a flowchart of the activity amount updating process performed every time the detection system 100 according to an embodiment of the present invention receives the user identifying information.

At first, the receiving unit 140 receives the user identifying information from the portable device 130, and sends it to the recording unit 200 within the detection server 160 along with the receiving unit identifying information for identifying that receiving unit 140 (S600). Next, the recording unit 200 adds time information indicating the received time to the received receiving unit identifying information and the user identifying information and records them in the position history database 210 (S610).

Next, the moving distance computing unit 220 computes a moving distance of the user 120 based on the history of the receiving unit identifying information on the user 120 stored on the position history database 210. Then, the moving distance computing unit 220 sends the computed moving distance to the calorie computing unit 280 (S620). Next, the moving speed computing unit 230 computes a moving speed of the user 120 based on the history of the receiving unit identifying information and time information on the user 120 stored on the position history database 210. Then, the moving speed computing unit 230 sends the computed moving speed to the calorie computing unit 280 (S630). Next, the staying time computing unit 240 computes the staying time for which the user was staying in the swimming pool based on time information about the user 120 stored on the position history database 210. Then, the staying time computing unit 240 sends the computed staying time to the calorie computing unit 280 (S640).

Next, the user information holding unit 250 acquires user information including the weight and height of the user 120 and sends this information to the calorie computing unit 280 (S650). Next, the water temperature acquiring unit 270 acquires a water temperature of the swimming pool 110 from the water temperature measuring unit 150 and sends it to the calorie computing unit 280 (S660).

Next, the density computing unit 255 computes density information indicating density of the plurality of users in the swimming pool 110 based on the receiving unit identifying information that is received by the plurality of receiving units 140 from the plurality of portable devices 130 and is stored on the position history database 210 (S662). Then, the flow computing unit 260 computes a flow generated by movements of the plurality of users in the swimming pool 110, and the flow information acquiring unit 275 acquires flow information from the flow generating apparatus 152 and/or the flow measuring unit 154 (S664).

Next, the calorie computing unit 280 computes the consumption calories of the user 120 based on the activity amount including the moving distance and the moving speed computed by the activity amount computing unit 215, the staying time computed by the staying time computing unit 240, the user information including the user's weight and height held in the user information holding unit 250, and the pool status including the water temperature, the flow information, and the density information on the swimming pool 110 computed or acquired by the pool status acquiring unit 252 (S670). Then, the calorie computing unit 280 sends activity amount information such as the activity amount and the consumption calories of the user 120 to the portable device 130 via the activity amount sending unit 170 corresponding to the receiving unit 140 that has received the user identifying information at the S600 (S680). Then, the portable device 130 displays the activity amount information received via the activity amount sending unit 170 on the display unit 330 (S690).

In addition, the processes from the S620 to the S660 described above may be performed in any order other than the order described above.

According to the detection system 100 described above, the receiving unit 140 in the vicinity of the portable device 130 retained by the user 120 receives the user identifying information from the portable device 130. Then, the detection server 160 can compute the activity amount and consumption calories of the user 120 based on the position of the receiving unit 140 that has received the user identifying information, the received time, the user information including the weight and height of the user 120, and the pool status such as the water temperature and flow of the swimming pool 110 or the density of the users. Thereby, according to the detection system 100 of the present embodiment, a detection system, by which the user 120 and the detection server 160 may know the activity amount and consumption calories of the user 120, can be realized.

Figure 8:
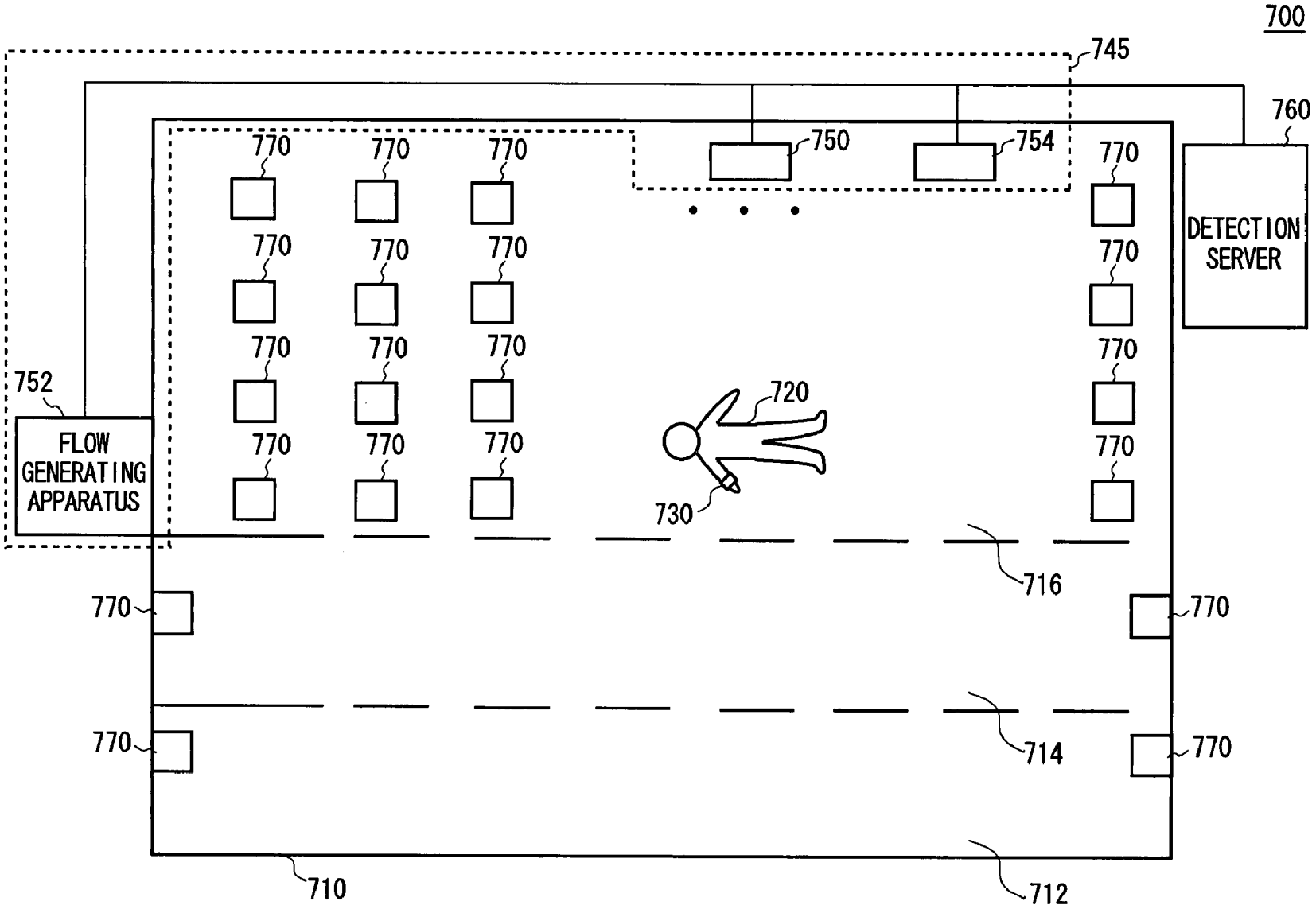
FIG. 8 shows a configuration of a detection system according to an alternative embodiment of the present invention.

FIG. 8 shows a configuration of a detection system 700 according to an alternative embodiment of the present invention. The detection system 700 according to this alternative includes a swimming pool 710, a portable device 730, a water temperature measuring unit 750, a pool status measuring unit 745, a detection server 760, and a sending unit 770. The detection server 760 according to this alternative is an example of a detection apparatus that detects an exercise history of a user in a swimming pool.

The swimming pool 710 includes a lane A 712 and a lane B 714 provided for the user 720 to swim and a free region 716 provided for the user 720 to freely do in-water exercise. Here, the swimming pool 710 may be used by a plurality of users. In the present alternative, the case of detecting an exercise history of the user 720 representative of the plurality of users will mainly be explained.

Each of the sending units 770 sends sending unit identifying information that is identification information different from each other to the portable device 730 retained by the user 720 by radio. Here, the sending unit 770 may continuously send the sending unit identifying information, or may send the sending unit identifying information at a predetermined interval.

The portable device 730 is retained by the user 720, and receives and stores the receiving unit identifying information sent from the sending unit 770 in a predetermined distance (for example, a radius of 50 cm, etc.). The portable device 730 may be a portable information device, a non-contact IC card or the like having a wristband shape being fixed to an arm, a head, or a foot of the user 720.

The pool status measuring unit 745 measures a pool status that is an internal status of the swimming pool 710, and sends it to the detection server 760. The pool status measuring unit 745 includes the water temperature measuring unit 750, a flow generating apparatus 752, and a flow measuring unit 754.

The water temperature measuring unit 750 measures a water temperature of the swimming pool 710 as a pool status, and sends it to the detection server 760. The flow generating apparatus 752 generates, for example, a flow in a horizontal direction and/or a flow in a vertical direction (waves, etc.) in the swimming pool 710. In addition, the flow generating apparatus 752 sends flow information including an intensity of the generated flow to the detection server 760 as a pool status. The flow measuring unit 754 acquires flow information including an intensity of the flow generated by the flow generating apparatus 752 and/or an intensity of a flow in the swimming pool generated by movements of the plurality of users in the swimming pool as a pool status.

The detection server 760 detects the exercise history of the user 720 based on a history of the sending unit identifying information stored on the portable device 730. Then, the detection server 760 computes an activity amount and consumption calories of the user 720 like the detection server 160 shown in FIG. 1.

Figure 9:
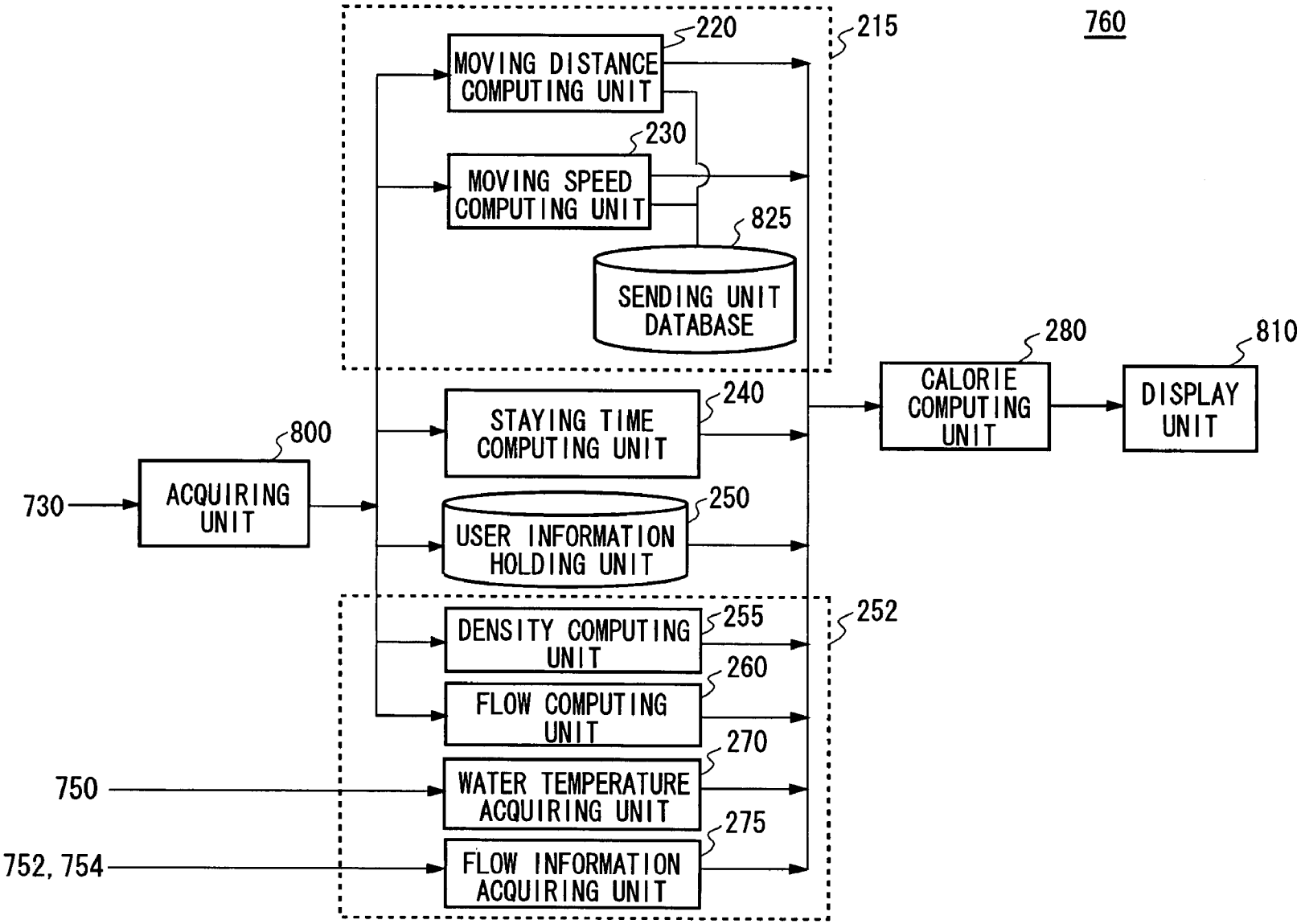
FIG. 9 shows a configuration of a detection server according to an alternative embodiment of the present invention.

FIG. 9 shows a configuration of the detection server 760 according to an alternative embodiment of the present invention. In comparison with the detection server 160 shown in FIG. 2, the detection server 760 according to this alternative substitutes an acquiring unit 800 for the recording unit 200 and the position history database 210, substitutes a sending unit database 825 for storing position information on the sending unit 770 like the receiving unit database 225 for the receiving unit database 225, and further includes a display unit 810. Since an activity amount computing unit 215, a staying time computing unit 240, a user information holding unit 250, a pool status acquiring unit 252, and a calorie computing unit 280 shown in FIG. 9 have the same configurations as those of FIG. 2, only the differences will be described hereinafter.

The acquiring unit 800 acquires user identifying information registered in the portable device 730, sending unit identifying information received and stored by the portable device 730, and time information indicating the time when the sending unit identifying information has been received from the portable device 730 as an exercise history of the user. The acquiring unit 800 may acquire the sending unit identifying information and the time information by radio or by way of a connector provided in the portable device 730.

In addition, the acquiring unit 800 further includes the position history database 210, and may store the sending unit identifying information and the time information in association with the user identifying information. In this way, a density computing unit 255 and a flow measuring unit 260 can respectively compute density of the plurality of users in the swimming pool 710 and a flow generated by movements of the plurality of users similarly to the density computing unit 255 and the flow measuring unit 260 in the detection apparatus 160 shown in FIG. 2.

The activity amount computing unit 215, the staying time computing unit 240, the user information holding unit 250, and a water temperature acquiring unit 270 in FIG. 9 perform substantially the same processes as those of members shown in FIG. 2. Here, the activity amount computing unit 215, the staying time computing unit 240, and the user information holding unit 250 in FIG. 9 respectively use the user identifying information, the sending unit identifying information, and the time information acquired from the portable device 730 in place of the user identifying information, the receiving unit identifying information, and the time information recorded in the position history database 210 shown in FIG. 2. Therefore, the activity amount computing unit 215 computes the activity amount based on the plurality of sending unit identifying information acquired by the acquiring unit 800. In addition, in regard to computation of the physical activity amount, a moving distance computing unit 220 and a moving speed computing unit 230 compute a moving distance and a moving speed based on a distance between the two sending units 770, which receive user identifying information in tandem, from each of the plurality of sending unit identifying information acquired by the acquiring unit 800.

The display unit 810 displays activity amount information such as the activity amount computed by the activity amount computing unit 215 and the consumption calories computed by the calorie computing unit 280. For example, the display unit 810 may further display information such as staying time computed by the staying time computing unit 240 and water temperature of the swimming pool 710 acquired by the water temperature acquiring unit 270.

Figure 10:
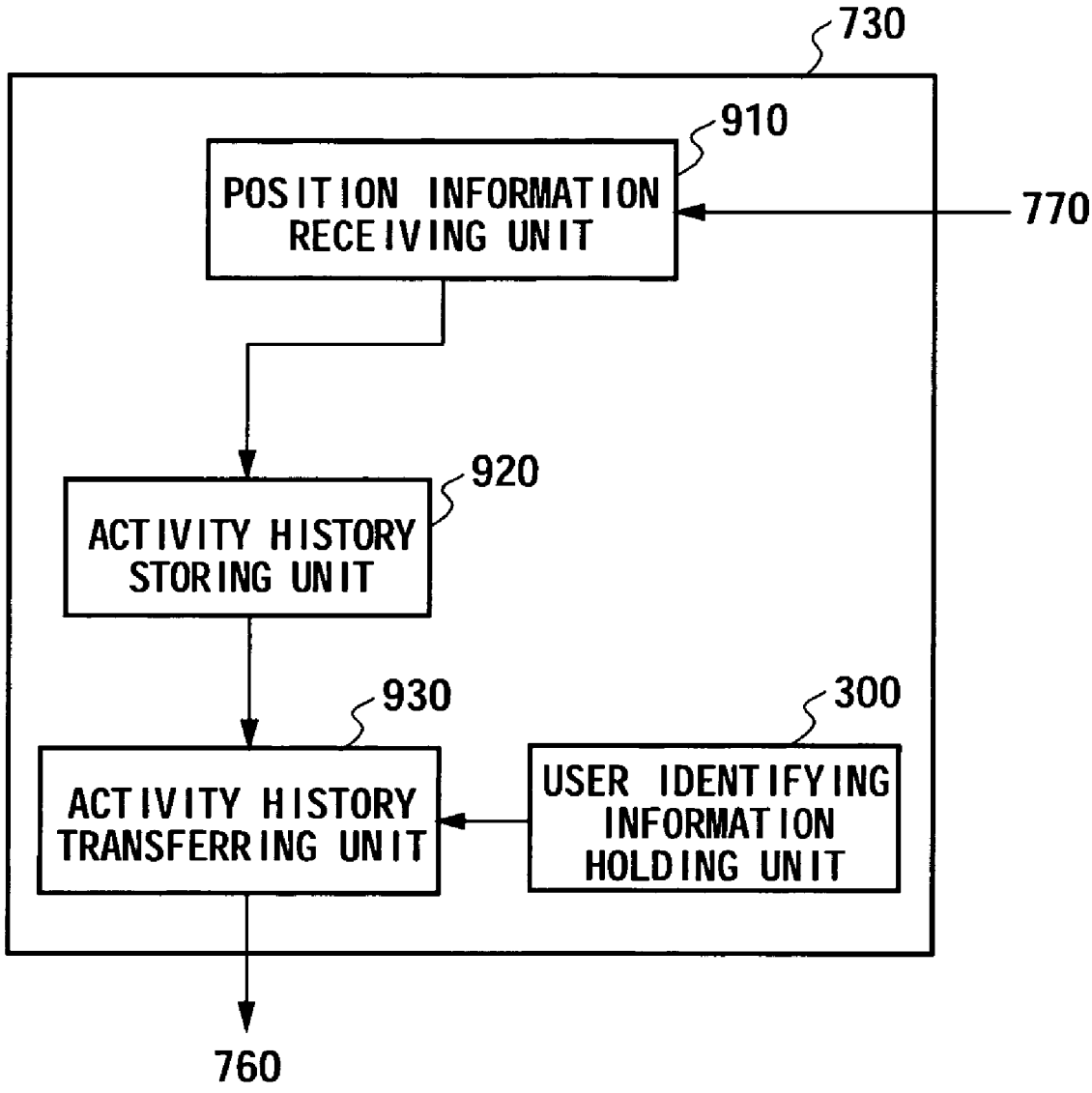
FIG. 10 shows a configuration of a portable device according to an alternative embodiment of the present invention.

FIG. 10 shows a configuration of the portable device 730 according to an alternative embodiment of the present invention. The portable device 730 according to this alternative includes a user identifying information holding unit 300, a position information receiving unit 910, an activity history storing unit 920, and an activity history transferring unit 930. The position information receiving unit 910 is an example of a receiving unit of a portable device according to the present invention. The activity history storing unit 920 is an example of a storing unit of a portable device according to the present invention. The activity history transferring unit 930 is an example of a transferring unit according to the present invention.

The user identifying information holding unit 300 holds the user identifying information on the user 720. The position information receiving unit 910 receives the sending unit identifying information from the sending unit 770 in the vicinity of the user by radio. The activity history storing unit 920 stores the sending unit identifying information received from the sending unit 770 in association with time information indicating the time when the sending unit identifying information has been received. After the user 720 has left from the swimming pool 710, the activity history transferring unit 930 sends the user identifying information in the user identifying information holding unit 300 and the history of the sending unit identifying information and time information stored on the activity history storing unit 920 to the acquiring unit 800.

According to the detection system 700 described above, the portable device 730 receives and stores the sending unit identifying information sent from the sending unit 770 in the vicinity of the user. Next, after the user 720 has come out of the swimming pool 710, the detection server 760 acquires the history of the user identifying information, the sending unit identifying information, and the time information from the portable device 730. Then, the detection server 160 can compute an activity amount and consumption calories of the user 720 based on the position of the sending unit 770 that has transmitted the sending unit identifying information, the time when the sending unit identifying information has been received, the weight and height of the user 720, and the water temperature of the swimming pool 710. In this way, according to the detection server 760 of this alternative, it is possible to realize the detection system capable of easily knowing the activity amount and consumption calories of the user 720.

Figure 11:
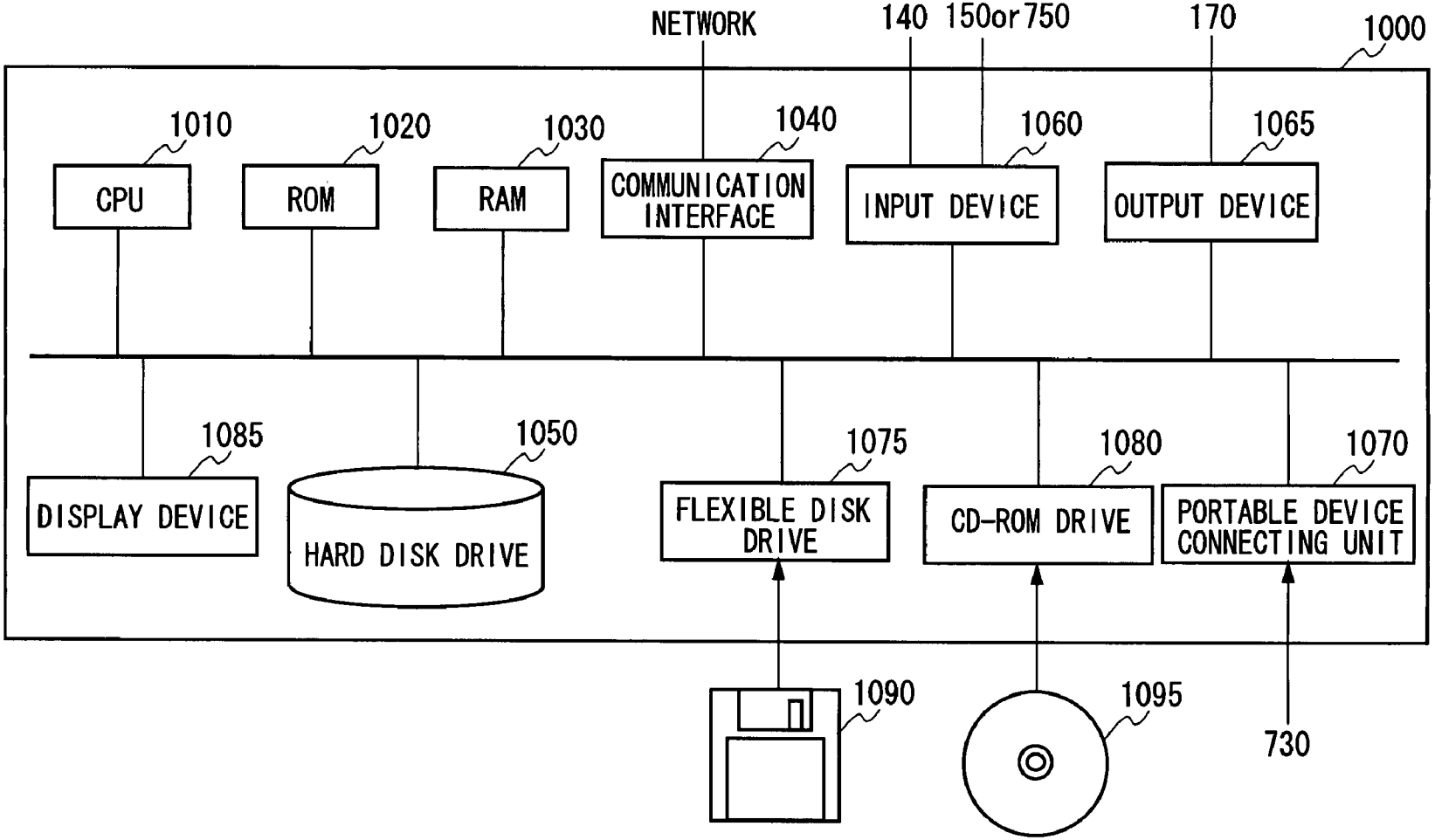
FIG. 11 shows a hardware configuration of a computer according to an embodiment of the present invention.

FIG. 11 shows a hardware configuration of a computer 1000 according to an embodiment of the present invention. The functions of the detection server 160 or the detection server 760 according to the present embodiment are realized by a computer 1000 including a CPU 1010, a ROM 1020, a RAM 1030, a communication interface 1040, a hard disk drive 1050, an input device 1060 for performing input from the receiving unit 140 and the water temperature measuring unit 150 or the water temperature measuring unit 750, an output device 1065 for performing output to the activity amount sending unit 170, and a portable device connecting unit 1070 being connected with the portable device 730 in a wired or wireless manner in cooperation with a program executed by the computer 1000. The computer 1000 may further include a flexible disk drive 1075 and/or a CD-ROM drive 1080.

A program to realize the detection server 160 includes a recording module, an activity amount computing module, a staying time computing module, a water temperature acquiring module, and a calorie computing module. These modules are programs that cause the computer 1000 to act as the recording unit 200, the activity amount computing unit 215, the staying time computing unit 240, the water temperature acquiring unit 270, and the calorie computing unit 280. In addition, the hard disk drive 1050 may be employed to store data recorded or held in the position history database 210, the receiving unit database 225, and the user information holding unit 250.

In addition, a program to realize the detection server 760 includes an acquiring module, an activity amount computing module, a staying time computing module, a water temperature acquiring module, a calorie computing module, and a displaying module. These modules are programs that cause the computer 1000 to act as the acquiring unit 800, the activity amount computing unit 215, the staying time computing unit 240, the water temperature acquiring unit 270, the calorie computing unit 280, and the display unit 810. In addition, the hard disk drive 1050 may be employed to store data recorded or held in the receiving unit database 225 and the user information holding unit 250.

The programs or modules described above may be stored on an external storage medium. As a storage medium, semiconductor memories such as an optical recording medium such as DVD or PD, a magneto-optical recording medium such as MD, a tape medium, and an IC card can be used in addition to a flexible disk 1090 and a CD-ROM 1095. In addition, storage devices such as a hard disk or RAM provided in a server system connected to a private communication network or Internet may be used as a storage medium so as to provide a program to the computer 1000 via a network connected to an external network or the computer 1000.

As is apparent from the above descriptions, according to the present invention, it is possible to realize a detection system that adequately measures an activity amount of a user in a swimming pool and computes consumption calories.

Although the present invention has been described by way of an exemplary embodiment, it should be understood that those skilled in the art might make many changes and substitutions without departing from the spirit and the scope of the present invention. It is obvious from the definition of the appended claims that embodiments with such alternatives also belong to the scope of the present invention.

What is claimed is:

1. A detection apparatus that detects an exercise history of a user in a swimming pool, comprising:

a plurality of receiving units operable to receive user identifying information for identifying the user from a portable device retained by the user;

a recording unit operable to recording receiving unit identifying information for identifying one of said receiving units in association with the user identifying information when the one receiving unit receives the user identifying information; and a activity amount computing unit operable to compute a physical activity amount of the user based on a history of the receiving unit identifying information stored in association with the user identifying information.

2. A detection apparatus as claimed in claim 1, wherein said activity amount computing unit computes the physical activity amount based on a distance between said two receiving units, which receive user identifying information in tandem, the user identifying information being stored on the history of the receiving unit identifying information corresponding to the user identifying information.

3. A detection apparatus as claimed in claim 1, wherein said recording unit further records time information indicating the time when receiving the corresponding user identifying information in association with the receiving unit identifying information, and said activity amount computing unit computes the physical activity amount based on the receiving unit identifying information and the time information.

4. A detection apparatus as claimed in claim 1, further comprising:

a user information holding unit operable to hold user information including the weight of the user; and a calorie computing unit operable to compute consumption calories of the user based on the held weight and the physical activity amount.

5. A detection apparatus as claimed in claim 4, wherein said recording unit further records time information indicating the time when receiving the corresponding user identifying information in association with the receiving unit identifying information, said activity amount computing unit computes a moving distance and a moving speed included in the physical activity amount of the user based on the receiving unit identifying information and the time information, and said calorie computing unit computes the consumption calories based on the moving distance, the moving speed, and the user information.

6. A detection apparatus as claimed in claim 1, wherein said recording unit further records time information indicating the time when receiving the corresponding user identifying information from the portable device as the receiving unit identifying information, the detection apparatus further comprises:

a staying time computing unit operable to compute a staying time for which the user was staying in the swimming pool; and a calorie computing unit operable to compute consumption calories of the user based on the physical activity amount and the staying time.

7. A detection apparatus as claimed in claim 1, wherein the portable device sends the user identifying information at predetermined times.

8. A detection apparatus as claimed in claim 1, further comprising a plurality of activity amount sending units operable to send the physical activity amount to the portable device retained by the user.

9. A detection apparatus as claimed in claim 8, wherein said activity amount sending units are respectively provided in the vicinity of said receiving units in correspondence with said receiving units for sending the physical activity amount from said activity amount sending unit corresponding to the one receiving unit to the portable device of the user when the one receiving unit receives the user identifying information.

10. A detection apparatus as claimed in claim 1, further comprising:

a pool status acquiring unit operable to acquire a pool status that is an internal status of the swimming pool; and a calorie computing unit operable to compute consumption calories of the user based on the physical activity amount and the pool status.

11. A detection apparatus as claimed in claim 10, wherein said pool status acquiring unit includes a water temperature acquiring unit that acquires a water temperature of the swimming pool as a pool status, and said calorie computing unit computes the consumption calories of the user based on the physical activity amount and the water temperature.

12. A detection apparatus as claimed in claim 11, wherein the user information further includes a user's temperature measured beforehand, said calorie computing unit computes the consumption calories of the user based on the physical activity amount and a difference between the user's temperature and the water temperature.

13. A detection apparatus as claimed in claim 10, wherein said pool status acquiring unit includes a flow information acquiring unit that acquires flow information including an intensity of a flow of the swimming pool as a pool status, and said calorie computing unit computes the consumption calories of the user based on the physical activity amount and the flow information.

14. A detection apparatus as claimed in claim 13, wherein the swimming pool includes a flow generating apparatus that generates a flow, and the flow information acquiring unit acquires flow information including an intensity of a flow generated from the flow generating apparatus as a pool status.

15. A detection apparatus as claimed in claim 10, wherein said pool status acquiring unit includes a density computing unit that computes density information indicating density of the plurality of users in the swimming pool as a pool status based on the history of the receiving unit identifying information that said plurality of receiving units receives from the plurality of portable devices carried by the plurality of users, and said calorie computing unit computes the consumption calories of the user based on the physical activity amount and the density information.

16. A detection apparatus as claimed in claim 10, wherein said pool status acquiring unit includes a flow computing unit that computes flow information indicating a flow in the swimming pool generated by a movement of the plurality of users as a pool status based on the history of the receiving unit identifying information that said plurality of receiving units receives from the plurality of portable devices carried by the plurality of users, and said calorie computing unit computes the consumption calories of the user based on the physical activity amount and the flow information.

17. A detection system that detects an exercise history of a user in a swimming pool, comprising:

a portable device operable to send user identifying information for identifying the user, said portable device is retained by the user; and a detection apparatus operable to receive the user identifying information from said portable device and compute a physical activity amount of the user, wherein said detection apparatus comprises:

a plurality of receiving units operable to receive user identifying information for identifying the user from said portable device retained by the user;

a recording unit operable to recording receiving unit identifying information for identifying one of said receiving units in association with the user identifying information when the one receiving unit receives the user identifying information; and a activity amount computing unit operable to compute a physical activity amount of the user based on a history of the receiving unit identifying information stored in association with the user identifying information.

18. A machine readable medium storing a program for a detection apparatus that detects an exercise history of a user in a swimming pool, the program causes the detection apparatus to act as:

a plurality of receiving units operable to receive user identifying information for identifying the user from a portable device retained by the user;

a recording unit operable to recording receiving unit identifying information for identifying one of said receiving units in association with the user identifying information when the one receiving unit receives the user identifying information; and a activity amount computing unit operable to compute a physical activity amount of the user based on a history of the receiving unit identifying information stored in association with the user identifying information.

19. A detection apparatus that detects an exercise history of a user in a swimming pool, comprising:

an acquiring unit operable to acquire a plurality of sending unit identifying information, which is received and stored by a portable device from a plurality of sending units that sends sending unit identifying information different from each other to the portable device retained by the user, from the portable device as an exercise history of the user; and a activity amount computing unit operable to compute a physical activity amount of the user based on the plurality of sending unit identifying information acquired by said acquiring unit.

20. A detection apparatus as claimed in claim 19, wherein said activity amount computing unit computes the physical activity amount with respect to each of the plurality of sending unit identifying information acquired by said acquiring unit based on a distance between said two sending units, which receive sending unit identifying information in tandem.

21. A portable device that detects an exercise history of a user in a swimming pool, comprising:

a receiving unit operable to receive sending unit identifying information from a plurality of sending units that is provided in the swimming pool and sends sending unit identifying information different from each other;

a storing unit operable to store the received sending unit identifying information; and a transmitting unit operable to transmit the sending unit identifying information stored on said storing unit as an exercise history of the user.

22. A detection system that detects an exercise history of a user in a swimming pool, comprising:

a plurality of sending units operable to send sending unit identifying information different from each other;

a portable device operable to receive and store the plurality of sending unit identifying information, said portable device is retained by the user; and a detection apparatus operable to compute a physical activity amount of the user based on the plurality of sending unit identifying information stored on said portable device, wherein said portable device includes:

a receiving unit that receives the sending unit identifying information from either of the sending units;

a storing unit that stores the received sending unit identifying information; and a transmitting unit that transmits the plurality of sending unit identifying information stored on the storing unit to said detection apparatus, and said detection apparatus includes:

an acquiring unit that acquires the plurality of sending unit identifying information stored on the storing unit from the transmitting unit; and a activity amount computing unit that computes a physical activity amount of the user based on the plurality of sending unit identifying information acquired by the acquiring unit.

23. A machine readable medium storing a program for a detection apparatus that detects an exercise history of a user in a swimming pool, the program causes the detection apparatus to operate by way of:

an acquiring unit operable to acquire a plurality of sending unit identifying information, which is received and stored by a portable device from a plurality of sending units that sends sending unit identifying information different from each other to the portable device retained by the user, from the portable device as an exercise history of the user; and a activity amount computing unit operable to compute a physical activity amount of the user based on the plurality of sending unit identifying information acquired by said acquiring unit.

* * * * *